US011859334B2

(12) United States Patent
Lee et al.

(10) Patent No.: US 11,859,334 B2
(45) Date of Patent: Jan. 2, 2024

(54) WASHING MACHINE

(71) Applicant: Samsung Electronics Co., Ltd., Suwon-si (KR)

(72) Inventors: Hyounyoung Lee, Suwon-si (KR); Younghyun Kim, Suwon-si (KR); Geun Kang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 54 days.

(21) Appl. No.: 17/567,294

(22) Filed: Jan. 3, 2022

(65) Prior Publication Data

US 2022/0178065 A1 Jun. 9, 2022

Related U.S. Application Data

(63) Continuation of application No. PCT/KR2021/018599, filed on Dec. 9, 2021.

(30) Foreign Application Priority Data

Dec. 9, 2020 (KR) ..... 10-2020-0171618

(51) Int. Cl.
*D06F 37/26* (2006.01)
*D06F 37/22* (2006.01)
*D06F 37/20* (2006.01)

(52) U.S. Cl.
CPC ..... *D06F 37/269* (2013.01); *D06F 37/206* (2013.01); *D06F 37/22* (2013.01); *D06F 37/264* (2013.01)

(58) Field of Classification Search
CPC ..... D06F 37/206; D06F 37/22; D06F 37/264; D06F 37/269
See application file for complete search history.

(56) References Cited

U.S. PATENT DOCUMENTS 7,536,882 B2 5/2009 Kim et al.
7,574,879 B2 8/2009 Chang et al.
(Continued)

FOREIGN PATENT DOCUMENTS

EP 2436823 A1 * 4/2012 ..... D06F 37/04
JP 2003-265887 9/2003
(Continued)

OTHER PUBLICATIONS

Electronic translation of KR 10-0535670 B1. (Year: 2005).*
PCT/ISA/210 dated Mar. 30, 2022 in International Patent Application No. PCT/KR2021/018599 (3 pages).

*Primary Examiner* — Joseph L. Perrin
(74) *Attorney, Agent, or Firm* — STAAS & HALSEY LLP

(57) ABSTRACT

A washing machine including a bearing housing to rotatably support a shaft configured to drive the drum and insertable into the tub, the bearing housing including a stator coupling portion to which a stator of a drive motor configured to rotate the shaft is coupled, and a plurality of leg portions spaced apart along a circumferential direction of the stator coupling portion. The plurality of leg portions include a leg plate including a first end connected to the stator coupling portion and a second end formed to extend along a radial direction of the stator coupling portion from the first end, a connection portion provided to connect between adjacent first ends of the plurality of leg portions, a separation space formed between second ends of the plurality of leg portions, and an outer rib formed along an edge of the leg plate and the connection portion.

14 Claims, 14 Drawing Sheets

(56) References Cited

U.S. PATENT DOCUMENTS

| | | | | |
|---|---|---|---|---|
| 7,827,834 | B2 | 11/2010 | Lim et al. | |
| 7,971,456 | B2 | 7/2011 | Kim | |
| RE43,625 | E | 9/2012 | Kim et al. | |
| 8,336,341 | B2 | 12/2012 | Kim et al. | |
| RE44,028 | E | 2/2013 | Kim et al. | |
| RE44,511 | E | 10/2013 | Kim et al. | |
| 8,590,347 | B2 | 11/2013 | Mola et al. | |
| RE44,674 | E | 12/2013 | Kim et al. | |
| RE44,795 | E | 3/2014 | Kim et al. | |
| 8,671,719 | B2 | 3/2014 | Chang | |
| 8,701,448 | B2 | 4/2014 | Jang et al. | |
| 9,062,404 | B2 | 6/2015 | Mola et al. | |
| 9,422,657 | B2 | 8/2016 | Kwon | |
| 9,951,456 | B2 | 4/2018 | Böttger et al. | |
| 2005/0005652 | A1* | 1/2005 | Park | D06F 37/264 68/24 |
| 2007/0074543 | A1* | 4/2007 | Lim | D06F 37/22 68/3 R |
| 2008/0110213 | A1 | 5/2008 | Choi et al. | |
| 2008/0178635 | A1 | 7/2008 | Ratfisch | |
| 2009/0044574 | A1* | 2/2009 | Lim | D06F 37/22 68/23.1 |
| 2009/0100879 | A1* | 4/2009 | Kim | D06F 37/269 74/572.4 |
| 2009/0113943 | A1* | 5/2009 | Lee | D06F 37/206 248/583 |
| 2012/0060566 | A1* | 3/2012 | Kim | D06F 37/267 68/140 |

FOREIGN PATENT DOCUMENTS

| | | |
|---|---|---|
| JP | 4044602 | 2/2008 |
| JP | 2011-234882 | 11/2011 |
| KR | 10-0214260 B1 | 8/1999 |
| KR | 10-0535670 B1 | 12/2005 |
| KR | 10-0640816 | 11/2006 |
| KR | 10-0651853 | 12/2006 |
| KR | 10-1061127 B1 | 8/2011 |
| KR | 10-1668452 | 10/2016 |

* cited by examiner

FIG. 11

| MODIFIER | VARIABLE | AXIAL STIFFNESS | INJECTION PROPERTY | SPACE UTILIZATION |
|---|---|---|---|---|
| HEIGHT OF OUTER RIB | 30mm | 8% ↑ | 15% ↓ | – |
| | 20mm | 7% ↑ | 12% ↓ | – |
| | 10mm | 4% ↑ | 7% ↓ | – |
| | 5mm | 2% ↑ | 3% ↓ | – |
| | 3mm | – | – | – |
| | 0mm | 5% ↓ | 3% ↑ | – |
| THE NUMBER OF LEG PORTION | 24 | 11% ↑ | 3% ↑ | 80% ↓ |
| | 18 | 8% ↑ | 1% ↑ | 40% ↓ |
| | 12 | – | – | – |
| | 10 | 4% ↓ | 3% ↓ | 20% ↑ |
| | 8 | 6% ↓ | 4% ↓ | 70% ↑ |
| | 6 | 9% ↓ | 5% ↓ | 112% ↑ |
| RATIO OF LENGTH OF LEG PORTION TO LENGTH OF CONNECTION PORTION | 90% | 5% ↑ | 2% ↑ | 94% ↓ |
| | 70% | 5% ↑ | 2% ↑ | 70% ↓ |
| | 50% | 5% ↑ | 2% ↑ | 45% ↓ |
| | 30% | 1% ↑ | 0.5% ↑ | 20% ↓ |
| | 20% | – | – | – |
| | 0% | 6% ↓ | 3% ↓ | 10% ↑ |

WASHING MACHINE

CROSS-REFERENCE TO RELATED APPLICATION(S)

This application is a continuation application, under 35 U.S.C. § 111(a), of international application No. PCT/KR2021/018599, filed Dec. 9, 2021, which claims priority under 35 U.S.C. § 119 to Korean Patent Application No. 10-2020-0171618, filed on Dec. 9, 2020, in the Korean Intellectual Property Office, the entire disclosures of all of which are herein incorporated by reference as a part of this application.

BACKGROUND

1. Field

The disclosure relates to a washing machine including a housing bearing including an improved structure.

2. Description of Related Art

In general, a washing machine is a device that washes laundry by performing washing, rinsing, and spin-drying operations.

According to a washing method, the washing machine is classified into a pulsator type in which water flow, which is generated when a rotary plate with small blades is rotated at the bottom of a washing tub, provides an impact to the laundry, an agitator type in which a large stirring blade with a wing is rotated in directions regularly reversed at the center of a washing tub to generate water flow so as to wash the laundry, and a drum type in which the laundry is put to a drum and the drum is rotated so as to wash the laundry with the impact caused by the fall and the cleaning power of the detergent.

The washing machine includes a cabinet, a tub installed inside the cabinet to receive washing water, a washing tub rotatably installed in the tub to receive laundry, a driving device configured to rotate the washing tub, and a water supply device configured to supply washing water to the tub and a drainage device configured to discharge washing water from the washing tub to the outside of the cabinet when washing is finished.

The washing machine may include a shaft configured to transmit a driving force of the driving device, and a bearing housing configured to rotatably support the shaft and provided on a rear surface of the tub.

In general, the tub may be manufactured by insert-injecting the bearing housing.

On the other hand, an axial stiffness of the tub and space utilization at the center of the rear surface of the tub may vary depending on the structure of the bearing housing.

SUMMARY

In accordance with an aspect of the disclosure, a washing machine includes a tub, a drum rotatably installable inside the tub, and a bearing housing provided to rotatably support a shaft configured to drive the drum while the drum is installed in the tub, the bearing housing being insertable into the tub, the bearing housing including a stator coupling portion to which a stator of a drive motor configured to rotate the shaft is coupled, and a plurality of leg portions spaced apart from each other along a circumferential direction of the stator coupling portion. Each of the plurality of leg portions includes a leg plate having a first end connected to the stator coupling portion and a second end formed to extend along a radial direction of the stator coupling portion from the first end, a connection portion provided to connect between adjacent first ends of the plurality of leg portions to each other, a separation space formed between second ends of the plurality of leg portions, and an outer rib formed along an edge of the leg plate and the connection portion.

Each of the plurality of leg portions may further include a central rib provided to cross a center of the leg plate. The central rib may extend from the stator coupling portion to a portion adjacent to the second end.

The outer rib and the central rib may be respectively formed to protrude from the leg plate in an axial direction of the shaft.

A length of the central rib in the axial direction may be greater than a length of the outer rib in the axial direction.

The central rib may include a first column formed to extend in the axial direction to reinforce a strength of the central rib and provided at one end of the central rib, and a second column provided between the one end and the other end of the central rib.

The central rib may further include a first reinforcing rib provided on opposite sides of the first column, and a second reinforcing rib positioned between the first column and the second column and provided on opposite sides of the central rib.

A number of the plurality of leg portions may be 12 (twelve).

The length of the outer rib in the axial direction may be 20 mm.

The connection portion may extend radially outward of the stator coupling portion from a side surface of the stator coupling portion.

When a length of the leg plate formed to extend from the first end to the second end is l, and a length of the connection portion formed to extend radially outward of the stator coupling portion from the stator coupling portion is t, a relation between l and t may be an expression $t/l=1/5$.

The leg plate may be provided to have a width that is reduced as a distance of the leg plate from the stator coupling portion is increased.

The leg plate may include a first section formed to extend from the first end and having a constant width, and a second section having a width greater than that of the first section and formed to extend from the first section to the second end.

At respective portions, the separation space has a first width, a second width different from the first width, and a third width different from the first width and the second width.

The plurality of leg plates may include at least one concave portion and at least one convex portion, which are provided on opposite sides of the plurality of leg portions between the first ends to the second ends of the plurality of leg portions.

In accordance with another aspect of the disclosure, a washing machine includes a tub, a drum positioned inside the tub and rotatably installed, and a bearing housing provided to rotatably support a shaft configured to drive the drum, the bearing housing insertable into the tub. The bearing housing includes a stator coupling portion to which a stator of a drive motor configured to rotate the shaft is coupled, at least 6 (six) leg plates including a first end connected to the stator coupling portion and a second end formed to extend along a radial direction of the stator coupling portion from the first end, a connection portion provided to connect between the first ends of the plurality of leg portions, a central rib provided to protrude from the leg plate in an axial direction of the shaft, provided to extend from the first end to the second end, and provided to cross a center of the leg plate, and an outer rib formed along an edge of the leg plate and the connection portion.

The bearing housing may include a separation space formed between the second ends.

A length of the outer rib protruding in the axial direction of the shaft may be 20 mm.

When a length of the leg plate extending outwardly of the stator coupling portion from the stator coupling portion is l, and a length of the connection portion formed to extend outwardly of the stator coupling portion from the stator coupling portion is t, a relation between l and t may be an expression t/l=1/5.

A length of the central rib protruding in the axial direction of the shaft from the leg portion may be greater than a length of the outer rib protruding in the axial direction.

In accordance with another aspect of the disclosure, a washing machine includes a tub, a drum positioned inside the tub and rotatably installed, and a bearing housing provided to rotatably support a shaft configured to drive the drum, the bearing housing insertable into the tub. The bearing housing includes a stator coupling portion to which a stator of a drive motor configured to rotate the shaft is coupled, 10 (ten) to 14 (fourteen) leg portions including a first end connected to the stator coupling portion, and provided to extend outwardly of the stator coupling portion from the first end, a connection portion provided to connect between the first ends of the plurality of leg portions, and a separation space formed between the first end of the plurality of leg portions and a second end opposite to the first end.

Additional aspects of the disclosure will be set forth in part in the description which follows and, in part, will be obvious from the description, or may be learned by practice of the disclosure.

BRIEF DESCRIPTION OF THE DRAWINGS

These and/or other aspects of the disclosure will become apparent and more readily appreciated from the following description of embodiments, taken in conjunction with the accompanying drawings of which:

FIG. 11 is a table illustrating values of axial stiffness, injection property, and space utilization of a tub, which vary according to a change in a structure of the bearing housing in the washing machine according to an embodiment of the disclosure;

DETAILED DESCRIPTION

Figure 1:
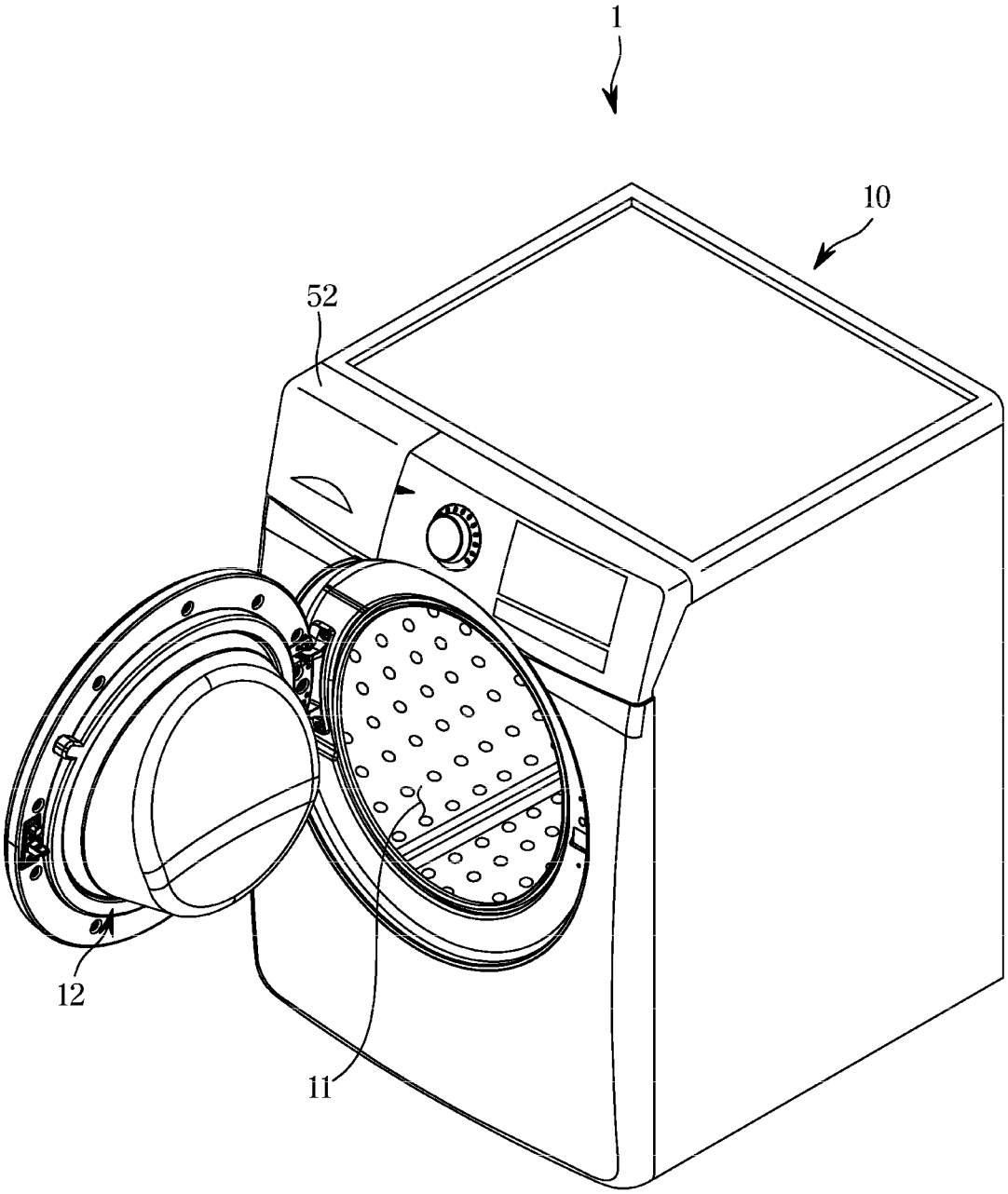
FIG. 1 is a perspective view of a washing machine according to an embodiment of the disclosure.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function. The shapes and sizes of elements in the drawings may be exaggerated for a clear description.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

Therefore, it is an aspect of the disclosure to provide a washing machine including a tub including an axial stiffness that is increased by improving a structure of a bearing housing.

It is another aspect of the disclosure to provide a washing machine including improved space utilization at a center of a rear surface of a tub by improving a structure of a bearing housing.

Figure 2:
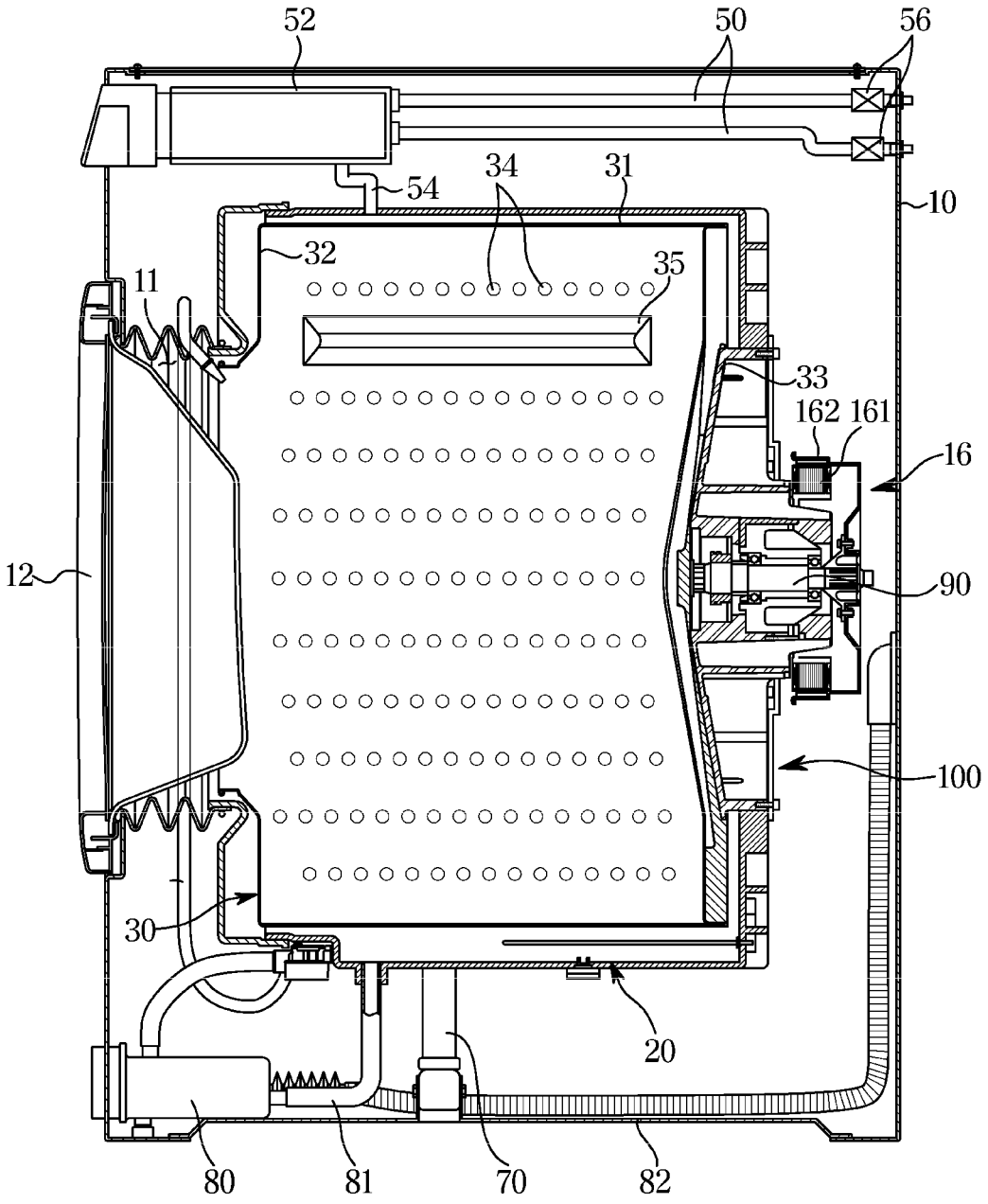
FIG. 2 is a side cross-sectional view of the washing machine according to an embodiment of the disclosure.
Figure 3:
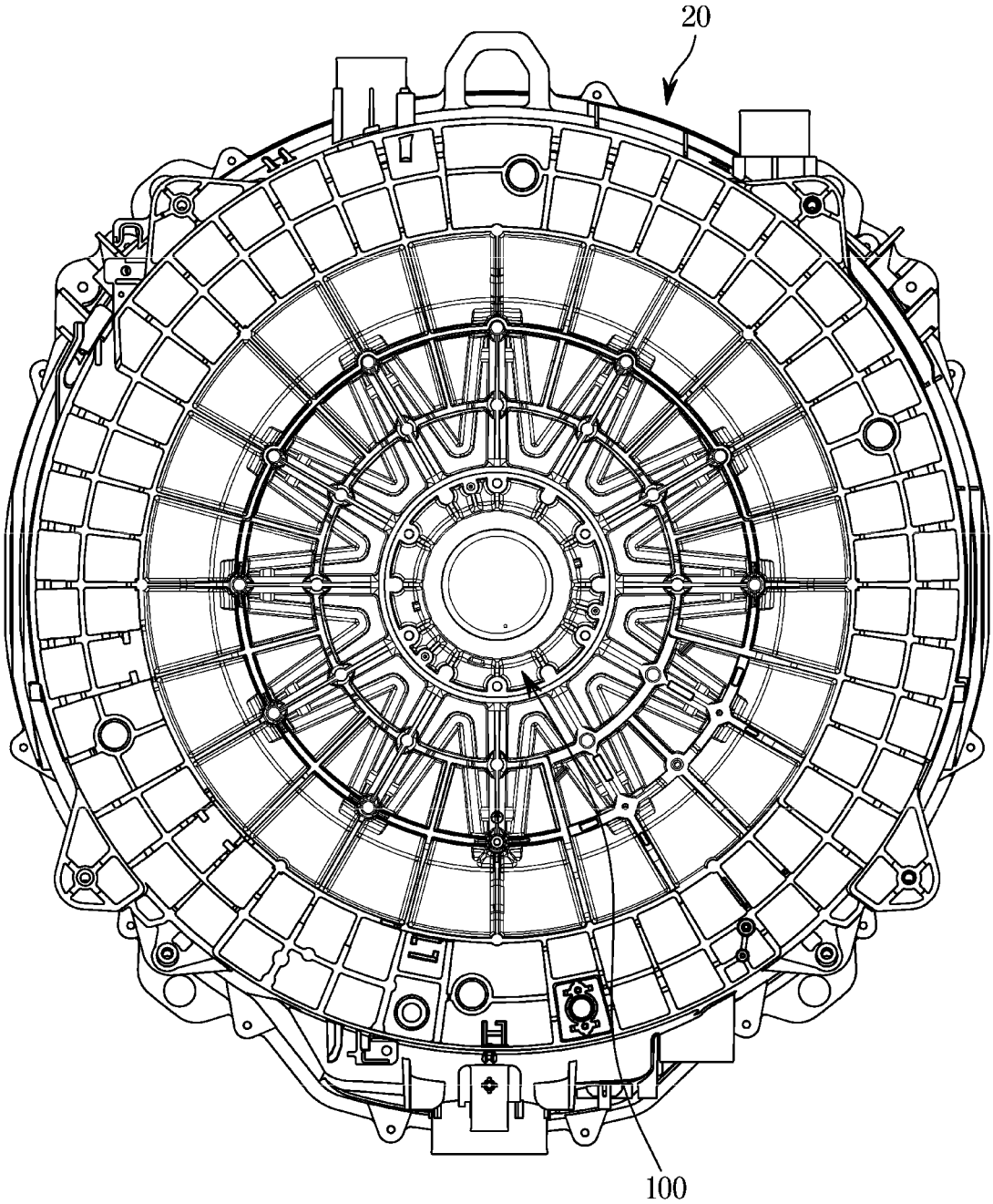
FIG. 3 is a view illustrating a rear surface of a tub in the washing machine according to an embodiment of the disclosure.

FIG. 1 is a perspective view of a washing machine according to an embodiment of the disclosure. FIG. 2 is a side cross-sectional view of the washing machine according to an embodiment of the disclosure. FIG. 3 is a view illustrating a rear surface of a tub in the washing machine according to an embodiment of the disclosure.

As illustrated in FIGS. 1 and 2, a washing machine 1 may include a main body 10 forming an exterior, a tub 20 arranged inside the main body 10, a drum 30 rotatably arranged inside the tub 20, and a drive motor 16 configured to drive the drum 30.

An inlet 11 may be formed in a front portion of the main body 10 to put laundry into the drum 30. The inlet 11 may be opened and closed by a door 12 installed on the front portion of the main body 10.

A water supply pipe 50 provided to supply washing water to the tub 20 may be provided above the tub 20. One side of the water supply pipe 50 may be connected to a water supply valve 56, and the other side of the water supply pipe 50 may be connected to a detergent box 52.

The detergent box 52 may be connected to the tub 20 through a connection pipe 54. Water supplied through the water supply pipe 50 may be supplied into the tub 20 together with the detergent via the detergent box 52.

The tub 20 may be supported by a damper 70. The damper 70 may connect an inner bottom surface of the main body 10 to an outer surface of the tub 20.

The drum 30 may include a cylindrical portion 31, a front plate 32 arranged in a front side of the cylindrical portion 31, and a rear plate 33 arranged in a rear side of the cylindrical portion 31. The drum 30 may be provided to be rotatable based on a rotation axis A extending in a front and rear direction of the washing machine 1. An opening 32*a* for entering and leaving laundry may be formed in the front plate 32 provided in the front side with respect to the rotation axis A. A shaft 90 provided to transmit power of the drive motor 16 may be connected to the rear plate 33 provided in the rear side with respect to the rotation axis A. A flange shift provided to support the shaft 90 may be mounted to the rear plate 33.

A plurality of through-holes 34 may be formed around the drum 30 for distribution of washing water, and a plurality of lifters 35 may be installed on an inner circumferential surface of the drum 30 to allow the laundry to rise and fall when the drum 30 is rotated.

The drum 30 and the drive motor 16 are connected through the shaft 90, and according to a connection method between the shaft 90 and the drive motor 16, the washing machine 1 may be classified into a direct drive type in which the shaft 90 is directly connected to the drive motor 16 so as to rotate the drum 30, and an indirect drive type in which a pulley is connected to between the shaft 90 and the drive motor 16 so as to drive the drum 30.

The washing machine 1 according to an embodiment of the disclosure may be provided as the direct drive type, but is not limited thereto. Therefore, technical features of the disclosure are applicable to the indirect drive type.

When provided as the direct drive type, the drum 30 is rotated by a rotational movement of the shaft 90, and the drum 30 is rotated around the shaft 90. The rotation axis A of the drum 30 may be provided on a line corresponding to the shaft 90.

As illustrated in FIG. 2, the drive motor 16 configured to rotate the drum 30 may be provided on the rear outer surface of the tub 20. The drive motor 16 includes a stator 161 installed in the tub 20, a rotor 162 configured to be rotated by interacting with the stator 161, and the shaft 90 provided in such a way that one end is installed on the rotor 162 and the other end is installed on the drum 30 by passing through the rear surface of the tub 20 so as to be rotated together with the rotor 162 to allow the drum 300 to be rotated.

When provided as the indirect drive type, although not shown in the drawings, one end of the shaft may be connected to the rear plate of the drum, and the other end of the shaft may extend to the rear of the tub. A drive pulley may be provided at the other end of the shaft to obtain a driving force from the drive motor. In addition, a motor pulley may be formed on the rotation axis of the drive motor, and a drive belt may be provided between the motor pulley and the drive pulley. Accordingly, the shift may be driven by the drive belt. The drive motor may be arranged on one side of the lower portion on an outer circumferential surface of the tub 20 to drive the shaft while the drive belt rotates clockwise or counterclockwise in a vertical direction of the tub.

Referring to FIG. 3, a bearing housing 100 provided to rotatably support the shaft 90 may be installed on the rear surface of the tub 20. The bearing housing 100 may be formed of an aluminum alloy. The bearing housing 100 may be inserted into the rear surface of the tub 20 when the tub 20 is injection molded.

A drain pump 80 configured to discharge water inside the tub 20 to the outside of the main body 10, a connection hose 81 provided to connect the tub 20 to the drain pump 80 to allow the water inside the tub 20 to be introduced into the drain pump 80, and a drain hose 82 provided to guide water pumped by the drain pump 80 to the outside of the body 10 may be provided under the tub 20.

A control panel and a printed circuit board assembly (not shown) may be provided on the front upper portion of the main body 10 to allow a user to control an operation of the washing machine 1.

Figure 4:
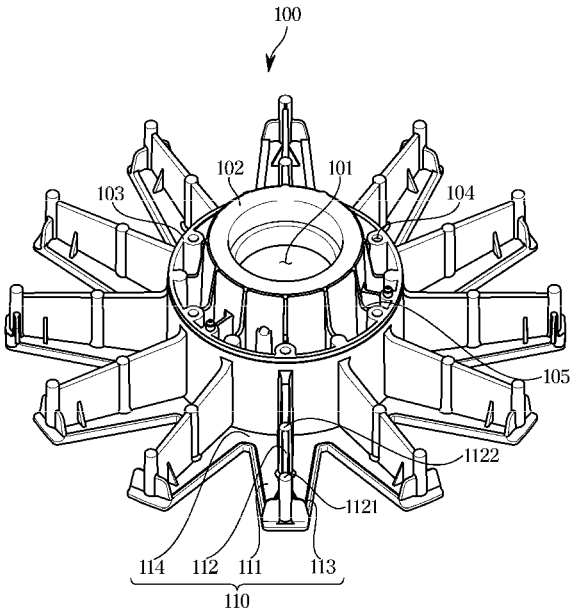
FIG. 4 is a view illustrating a bearing housing separated from the washing machine according to an embodiment of the disclosure.
Figure 5:
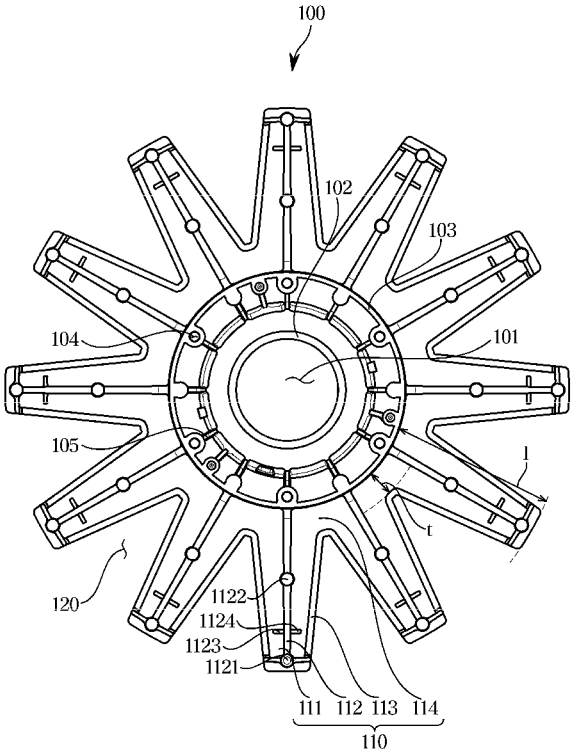
FIG. 5 is a view illustrating the bearing housing illustrated in FIG. 4 at another angle.
Figure 6:
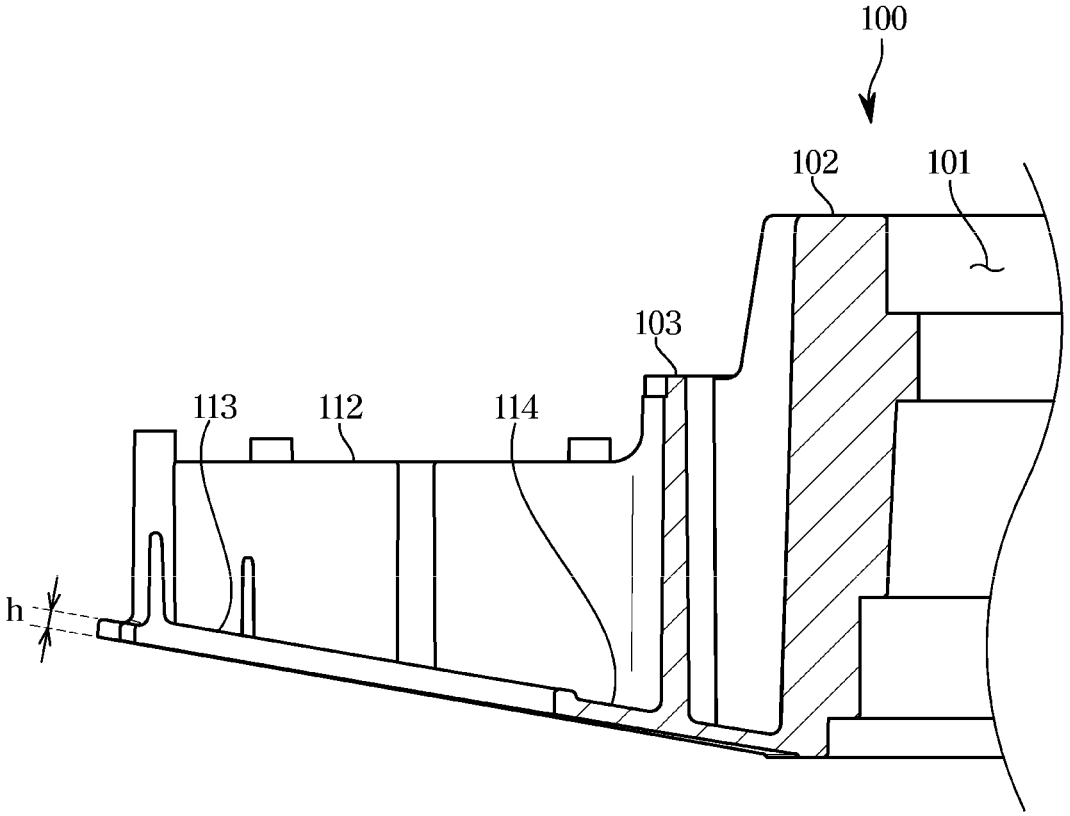
FIG. 6 is a cross-sectional view illustrating a part of the bearing housing illustrated in FIG. 4.

FIG. 4 is a view illustrating a bearing housing separated from the washing machine according to an embodiment of the disclosure. FIG. 5 is a view illustrating the bearing housing illustrated in FIG. 4 at another angle. FIG. 6 is a cross-sectional view illustrating a part of the bearing housing illustrated in FIG. 4.

A structure of the bearing housing 100 according to an embodiment of the present disclosure will be described in detail with reference to FIGS. 4 to 6.

According to an embodiment of the disclosure, the bearing housing 100 may include a shaft hole 101 into which the shaft 90 is inserted, a shaft support portion 102 including the shaft hole 101 and provided to support the shaft 90, a stator coupling portion 103 provided in a cylindrical shape surrounding the outer surface of the shaft support portion 102, a fastening portion 104 provided to be spaced apart along an inner circumferential surface of the stator coupling portion 103, and a shaft reinforcing rib 105 provided to connect the shaft support portion 102 to the stator coupling portion 103. When the tub 20 is manufactured, the bearing housing 100 may be inserted such that the shaft support 102 faces the outside of the rear surface of the tub 20.

As illustrated in FIG. 4, a height of the shaft support portion 102 may be greater than a height of the stator coupling portion 103. In this case, the height indicates a length in the vertical direction with respect to FIG. 4.

A stator (not shown) of the drive motor 40 may be coupled to the stator coupling portion 103. The fastening portion 104 may be positioned adjacent to the inner circumferential surface of the stator coupling portion 103, and may be spaced apart along a circumferential direction of the inner circumferential surface of the stator coupling portion 103. Various fastening members (not shown) including screws may be fastened to the fastening portion 104. After arranging the stator on the stator coupling portion 103, the stator may be coupled to the stator coupling portion 103 by fastening the fastening member to the fastening portion 104.

The shaft reinforcing rib 105 may be provided to connect between the shaft support portion 102 and the stator coupling portion 103. The shaft reinforcing rib 105 may be provided in plural, and the plurality of shaft reinforcing ribs 105 may be arranged to be spaced apart from each other along the circumferential direction of the outer circumferential surface of the shaft support portion 102. Because the shaft reinforcing rib 105 is provided, the shaft support portion 102 positioned inside the stator coupling portion 103 may rotatably support the shaft 90 without being deformed.

According to an embodiment of the disclosure, the bearing housing 100 may include a leg portion 110 extending outwardly from the outer circumferential surface of the stator coupling portion 103. The leg portion 110 may be provided in plural. The plurality of leg portions 110 may be arranged to be spaced apart from each other in the circumferential direction of the stator coupling portion 103.

According to an embodiment of the disclosure, the leg portion 110 may include a leg plate 111 forming a bottom surface of the leg portion, a central rib 112 provided to cross a center of the leg plate 111 and provided to protrude upward from the leg plate 111, and an outer rib 113 formed along an edge of the leg plate 111. In this case, "upward" indicates an upward direction in FIG. 4.

In addition, the bearing housing 100 may include a connection portion 114 provided to connect two leg portions 110 adjacent to each other. Particularly, the connection portion 114 may connect two leg portions 111 adjacent to each other. In addition, the connection portion 114 may extend radially outward of the stator coupling portion 103 from the outer circumferential surface of the stator coupling portion 103.

According to an embodiment of the disclosure, the leg plate 111 and the connection portion 114 may form the same surface. In addition, the leg plate 111 and the connection portion 114 may be integrally formed with each other.

The plurality of leg plates 111 may extend radially from the outer circumferential surface of the stator coupling portion 103. Each of the plurality of leg plates 111 may be provided to extend outwardly from the outer circumferential surface of the stator coupling portion 103 such that a width of the leg plate 111 is gradually reduced as the leg plate 111 extends outwardly of the stator coupling portion 103.

The leg plate 111 may include a first end 115 connected to the stator coupling portion 103 and a second end 116 extending radially outward of the stator coupling portion 103 from the first end 115.

The central rib 112 may be provided to cross the center of the leg plate 111. The central rib 112 may extend in a direction in which the leg plate 111 extends from the outer circumferential surface of the stator coupling portion 103. The central rib 112 may be provided in such a way that a height thereof is maximum on the outer circumferential surface of the stator coupling portion 103, and the height thereof is reduced as the central rib 112 is away from the stator coupling portion 103. In this case, "height" indicates a length in the vertical direction in FIG. 4.

The leg plate 111 may be inclined upwardly from the first end 115 to the second end 116. Because the height of the leg plate 111 is increased from the first end 115 to the second end 116, there is no difference in the height of an upper surface of the central rib 112. However, because the height of a lower surface in contact with the leg plate 111 is changed, the height of the leg plate 111 may be gradually reduced.

The central rib 112 may include a first column 1121 and a second column 1122. The first column 1121 and the second column 1122 may be provided to reinforce a strength of the central rib 112. The first column 1121 and the second column 1122 may be positioned on one side of the central rib 112 and may be provided in a cylindrical shape. The first column 1121 and the second column 1122 may be formed to protrude from the leg plate 111 in the axial direction of the shaft.

The first column 1121 may be provided at one end of the central rib 112. The second column 1122 may be provided between the one end of the central rib 112 and the other end of the central rib 112. The second column 1122 may be located approximately at the center of the central rib 112.

The central rib 112 may further include a pair of first reinforcing ribs 1123 provided on opposite sides of the first column 1122. The first reinforcing rib 1123 may be provided in a substantially trapezoidal shape. The first reinforcing rib 1123 may be provided to reinforce the strength of the central rib 112.

The central rib 112 may further include a pair of second reinforcing ribs 1124 positioned between the first column 1122 and the second column 1123 and provided on opposite sides of the central rib 112. The second reinforcing rib 1124 may be provided in a substantially triangular shape. The second reinforcing rib 1124 may be provided to reinforce the strength of the central rib 112.

The outer rib 113 may be formed along the edge of the leg plate 111 and the connection portion 114. The outer rib 113 may be formed to protrude upward from the leg plate 111 by a predetermined height, and similarly, may be formed to protrude upward from the connection portion 114 by the predetermined height.

The outer rib 113 may be provided so as not to contact the stator coupling portion 103. As described above, because the connection portion 114 protrudes outwardly from the stator coupling portion 103 and the outer rib 113 is formed along the edge of the connection portion 114, the outer rib 113 may be spaced apart from stator coupling portion 103 in the radial direction of the stator coupling portion 103.

Referring to FIG. 5, the bearing housing 100 according to an embodiment of the disclosure may include a plurality of leg portions 110 formed not to be connected to each other. As described above, in a region adjacent to the stator coupling portion 103, the plurality of leg portions 110 may be connected by the connection portion 114. When a portion connected to the connection portion 114 is referred to as one end of the leg portion 110, the other end of the leg portion 110 may be provided so as not to be connected to the other end of the adjacent leg portion 110. In other words, the plurality of leg plates 111 adjacent to each other may be connected by the connection portion 114. The first end 115 of the leg plate 111 may be connected to the connection portion 114. The second end 116 of the leg plates 111 adjacent to each other may be provided to be spaced apart from each other so as not to be connected to each other. Accordingly, the bearing housing 100 may include a separation space 120 provided between a pair of adjacent leg portions 110.

According to the disclosure, because the bearing housing 100 includes the separation space 120, the space utilization of the center of the rear surface of the tub 20 may be improved.

Conventionally, a bearing housing does not include a separation space. The conventional bearing housing includes a ring-shaped rib at the outermost portion, and includes a plurality of leg portions connecting the ring-shaped rib to a stator coupling portion arranged inside the ring-shaped rib.

As for the conventional bearing housing, it is difficult to arrange a hole or the like inside the ring-shaped rib, and thus there is a limit to the space utilization of the center of the rear surface of the tub. Therefore, it is impossible to arrange a hole or other component, which is required for the washing machine, in the center of the rear of the tub, and the hole or other component may be arranged on the outside of the bearing housing. As a result, the space utilization at the center of the rear of the tub is reduced.

According to an embodiment of the disclosure, the bearing housing 100 may include the separation space 120 provided between the plurality of leg portions 110. A configuration necessary for the washing machine, such as a hole, may be arranged in the separation space 120. Accordingly, the space utilization at the center of the rear surface of the tub may be improved.

In addition, the conventional bearing housing does not include an outer rib. The outer rib refers to a rib formed along the edge of the leg portion and the connection portion, as described above. In the conventional bearing housing, a protruding rib is not provided at opposite side ends of the leg portion. That is, the conventional leg portion is composed of only the leg plate.

When the tub is injection molded after inserting the conventional bearing housing, opposite side ends of the leg portion are provided flat, and thus a force of the injection material surrounding the leg portion to grip the leg portion is relatively weak. In addition, a certain gap is formed between the flat leg portion and the injection molded product surrounding the leg portion due to the characteristics of injection molding. Accordingly, the axial stiffness of the bearing housing is relatively weak, and the injection force of the bearing housing is relatively weak. Hereinafter, the force of the injection molding surrounding the inserted bearing housing to grip the bearing housing is referred to as an injection force.

According to an embodiment of the disclosure, the bearing housing 100 may include the outer rib 113 formed along the edge of the leg plate 111 and the connection portion 114. Because the bearing housing 100 includes the outer rib 113, the injection force of the tub 20 may be increased. In addition, the axial stiffness of the tub 20 may be increased.

When the outer rib 113 is provided, opposite ends of the leg plate 111 protrude upward. Due to the protrusion structure, the force of the injection molding surrounding the leg plate 111 to fix the leg plate 111 is increased, and thus, the injection force may be increased. As the injection force is increased, the inserted bearing housing 100 may be strongly fixed to the tub 20, and the axial stiffness of the tub 20 may be increased. Therefore, according to an embodiment of the disclosure, the axial stiffness of the tub 20 may be increased.

Referring to FIG. 5, the bearing housing 100 according to an embodiment of the disclosure may include 12 (twelve) leg portions 110. The 12 (twelve) leg portions 110 may be radially arranged from the stator coupling portion 103.

The leg portion 110 may have a predetermined length l. The length of the leg portion 110 may indicate a distance from the outer surface of the stator coupling portion 103 to the end of the leg portion 110. In other words, the length of the leg portion 110 may indicate a length from the first end 115 to the second end 116 of the leg plate 111.

The connection portion 114 may have a predetermined length t. The length of the connection portion 114 may indicate a distance from the outer surface of the stator coupling portion 103 to the end of the connection portion 114.

Referring to FIG. 6, the bearing housing 100 according to an embodiment of the disclosure may include the outer rib 113 having a predetermined height h. In other words, the outer rib 113 may have the predetermined height h.

Figure 7:
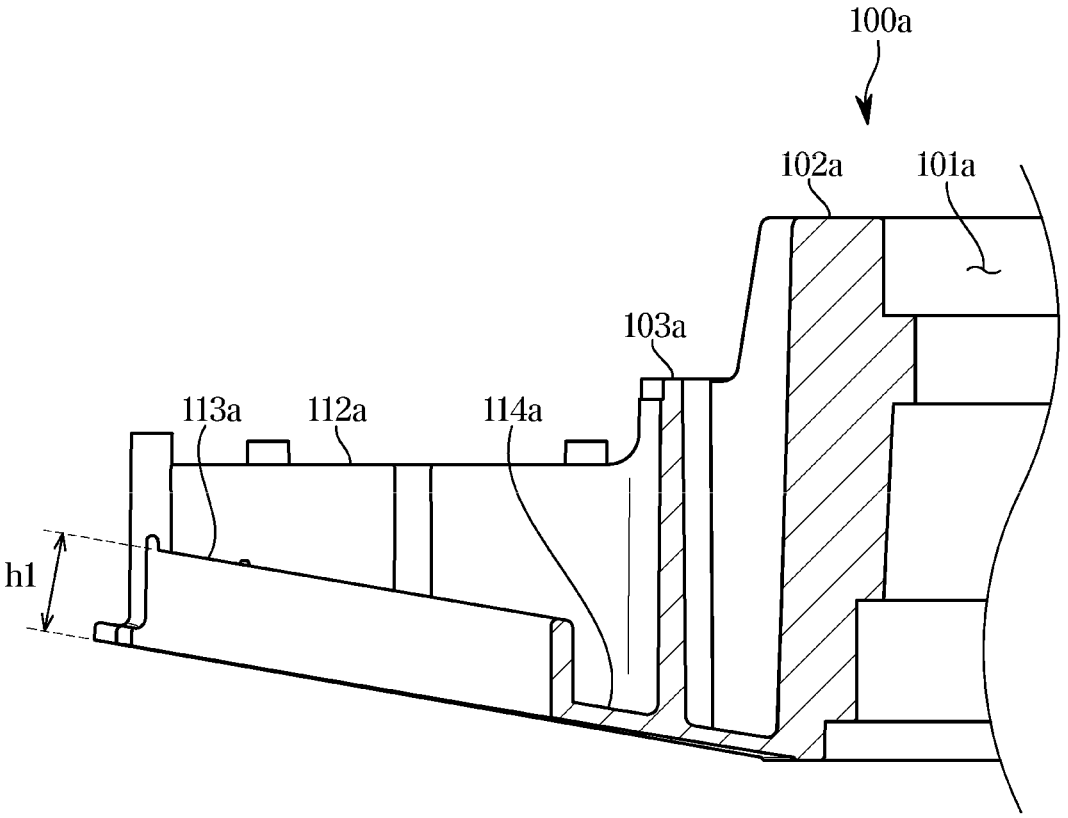
FIG. 7 is a view illustrating a state in which a height of an outer rib is changed in the bearing housing illustrated in FIG. 6.
Figure 8:
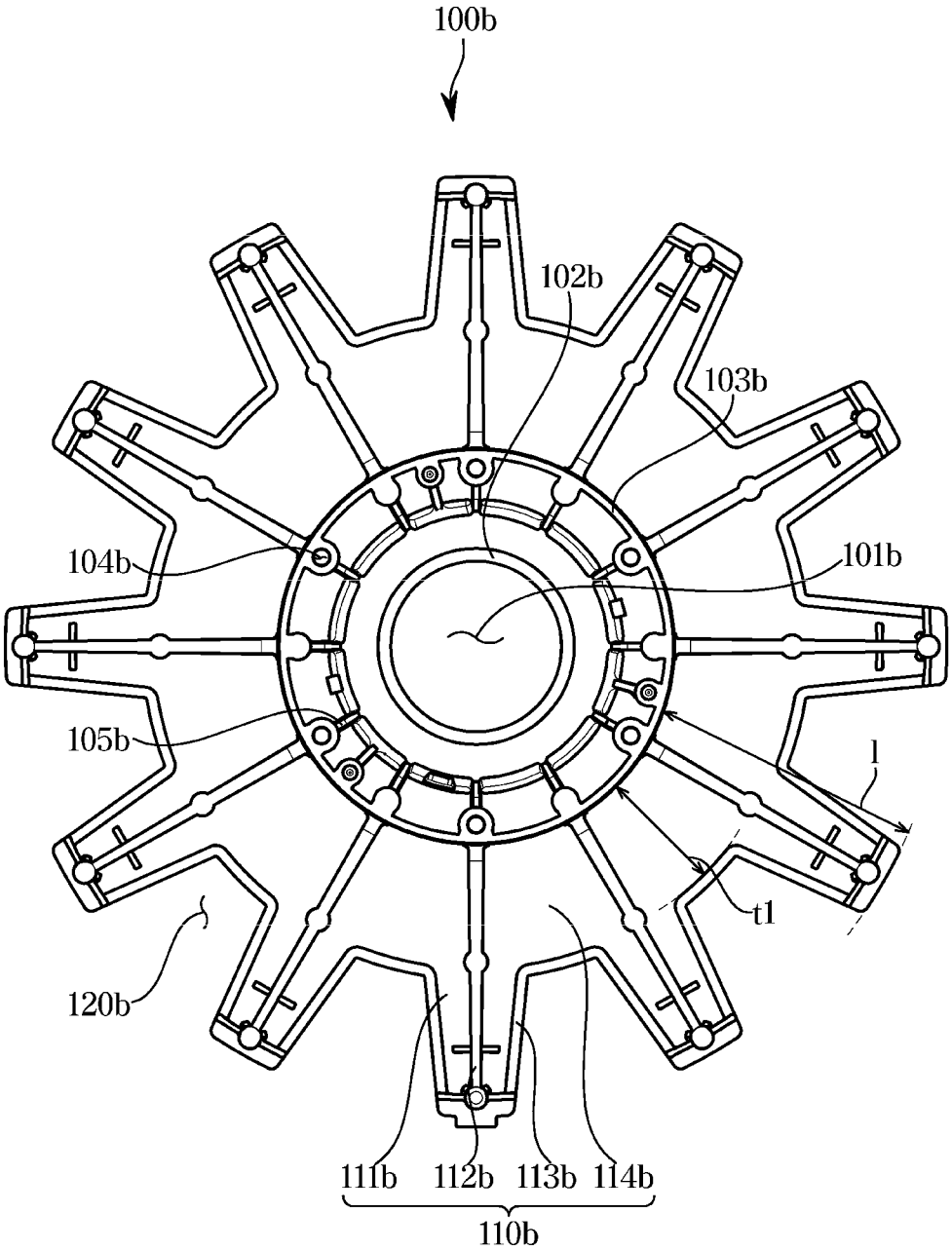
FIG. 8 is a view illustrating a state in which a ratio of a length of a connection portion to a length of a leg portion is changed in the bearing housing illustrated in FIG. 5.
Figure 9:
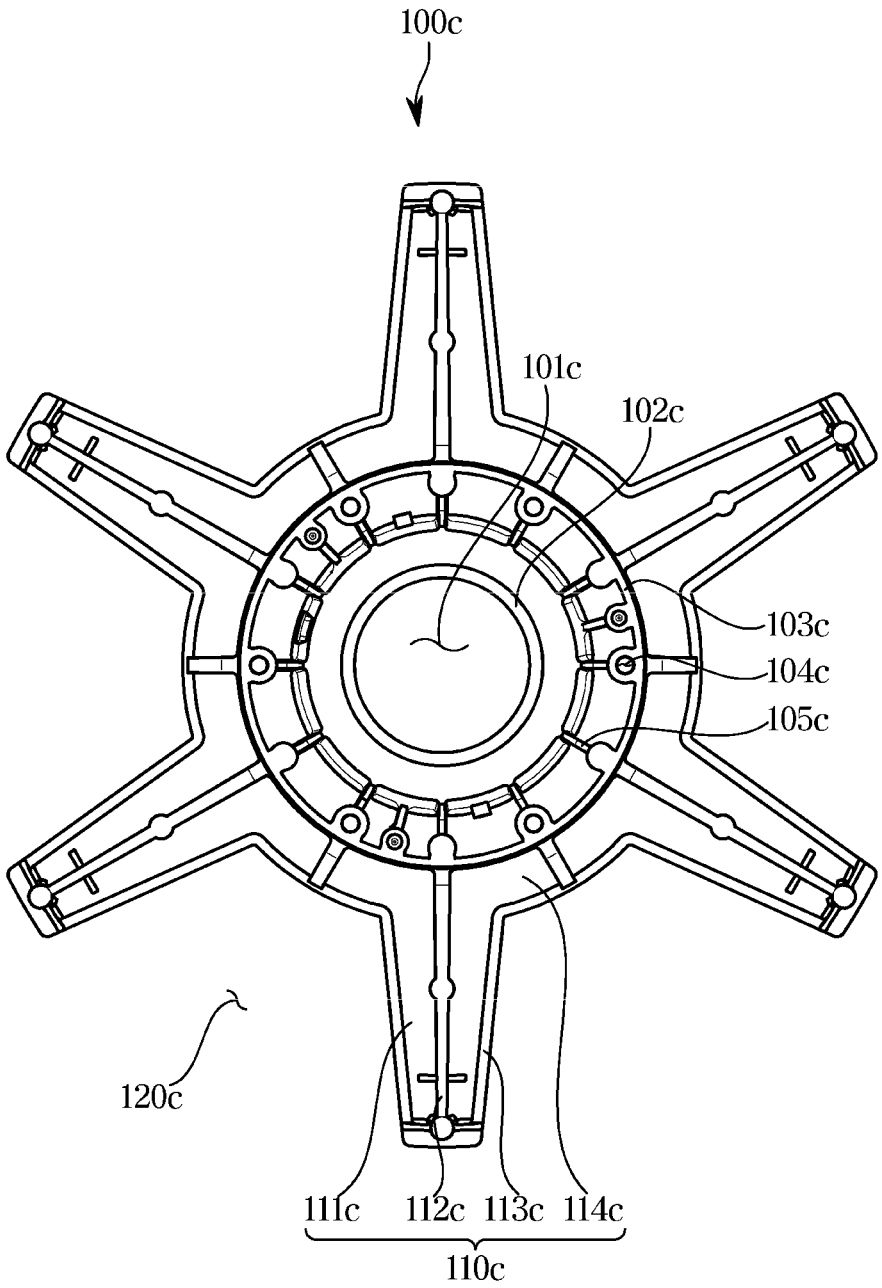
FIG. 9 is a view illustrating a state in which the number of leg portions is reduced in the bearing housing illustrated in FIG. 5.
Figure 10:
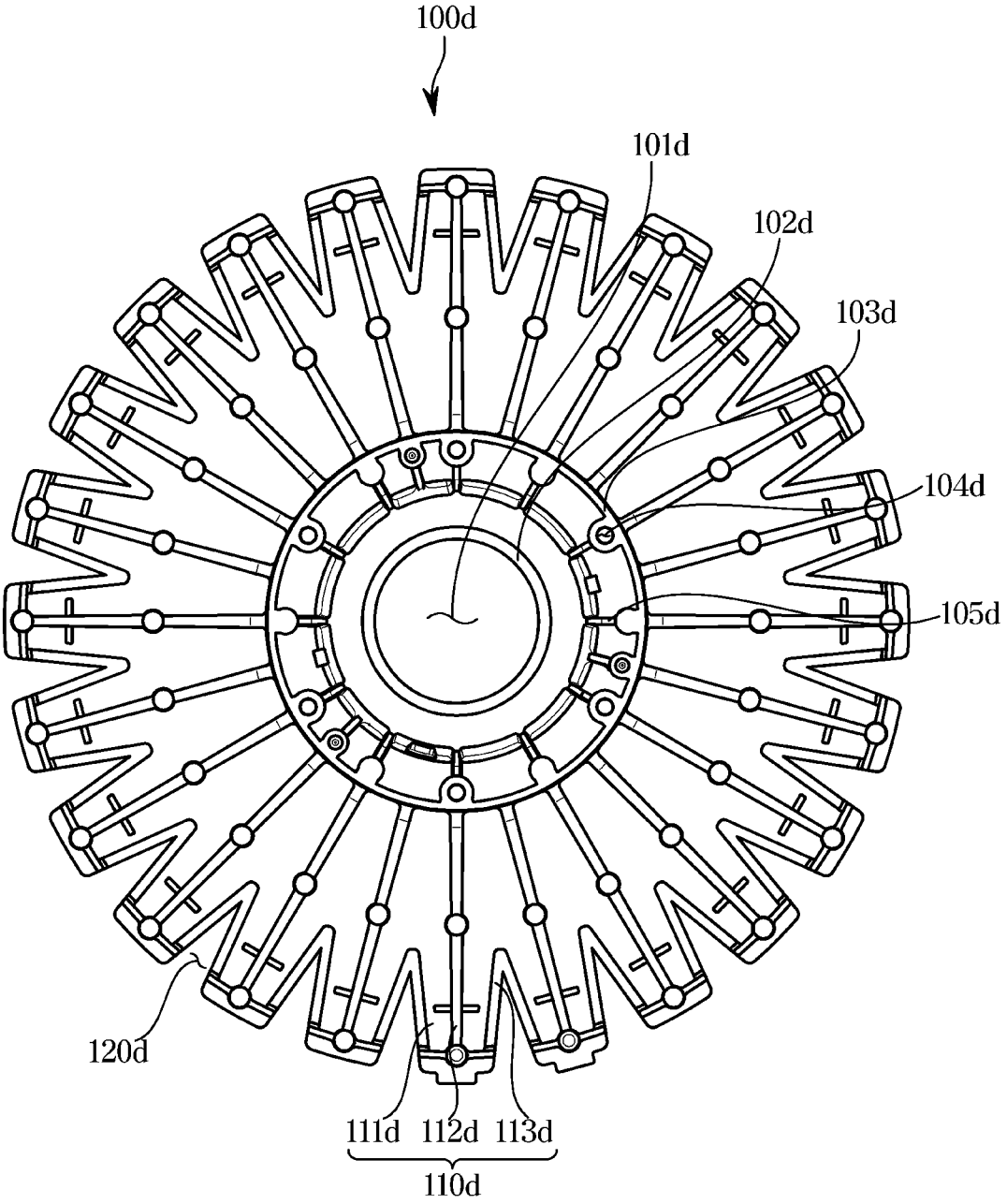
FIG. 10 is a view illustrating a state in which the number of leg portions is increased in the bearing housing illustrated in FIG. 5.

FIG. 7 is a view illustrating a state in which a height of an outer rib is changed in the bearing housing illustrated in FIG. 6. FIG. 8 is a view illustrating a state in which a ratio of a length of a connection portion to a length of a leg portion is changed in the bearing housing illustrated in FIG. 5. FIG. 9 is a view illustrating a state in which the number of leg portions is reduced in the bearing housing illustrated in FIG. 5. FIG. 10 is a view illustrating a state in which the number of leg portions is increased in the bearing housing illustrated in FIG. 5. FIG. 11 is a table illustrating values of axial stiffness, injection property, and space utilization of a tub, which vary according to a change in a structure of the bearing housing in the washing machine according to an embodiment of the disclosure.

Hereinafter a change in the axial stiffness, injection property, and space utilization of the tub according to the structural change of the bearing housing will be described with reference to FIGS. 7 to 11.

FIG. 7 illustrates a bearing housing 100*a* in which the structure is partially changed from the bearing housing 100 according to an embodiment of the present disclosure. The bearing housing 100*a* may include an outer rib 113*a* having a predetermined height h1. Configurations other than the height of the outer rib 113*a* are the same as those shown in FIGS. 4 to 6, and thus a description thereof will be omitted.

When the height h1 of the outer rib 113*a* of the bearing housing 100*a* is compared with the height h of the outer rib 113 of the bearing housing 100, it is as follows.

$$h1>h$$

According to an embodiment of the present disclosure, an optimal effect is obtained in response to the height of the outer rib being 3 mm. Referring to FIG. 11, it can be seen that in response to the height of the outer rib being increased with respect to the height of the outer rib of 3 mm, the axial stiffness is increased but the injection property is reduced. At this time, it is appropriate that the height of the outer rib is 3 mm because a rate, at which the injection property is reduced, is greater than a rate, at which the axial stiffness is increased. In addition, in response to the height of the outer rib being 0 (zero), that is, when the outer rib is not provided, the axial stiffness is reduced and the injection property is increased. At this time, because the rate, at which the axial stiffness is reduced, is greater than the rate, at which the injection property is increased, it is appropriate that the height of the outer rib is 3 mm.

Referring to FIG. 11, it can be seen that in response to the height of the outer rib being greater or less than 3 mm, a rate at which one of the axial stiffness and the injection property is reduced is larger than a rate at which any one of the axial stiffness and the injection property is increased. That is, it can be seen that, in response to the height of the outer rib being 3 mm, the balance between the axial stiffness and the injection property is most appropriate. Therefore, according to an embodiment of the disclosure, it is appropriate that the height of the outer rib is provided to be 3 mm.

Referring to FIG. 8, a length t1 of a connection portion 114*b* of a bearing housing 100*b* is greater than the length t of the connection portion 114 of the bearing housing 100. That is, t1>t. In FIG. 8, the configuration other than the length t1 of the connection portion 114*b* is the same as that of the bearing housing 100, and thus a description thereof will be omitted.

Referring to FIG. 11, as the ratio of the length of the connection portion to the length of the leg portion is changed, the axial stiffness, injection property, and space utilization of the tub are changed.

It is appropriate that the ratio of the length t of the connection portion to the length l of the leg portion, that is, t/l, is 20%. In response to t/l being greater than 20%, the axial stiffness and injection property are increased, but the space utilization is reduced than the increase of the axial stiffness and injection property. In response to t/l being 0 (zero), that is, the connection portion 114 is not provided, the space utilization is partially increased, but the axial stiffness and injection property are reduced than the increase of the space utilization. Therefore, it is appropriate that t/l is 20%.

Referring to FIG. 9, a bearing housing 100*c* may include 6 (six) leg portions 110*c*. All configurations except for the number of leg portions 110*c* are the same as those of the bearing housing 100.

Referring to FIG. 10, a bearing housing 100*d* may include 24 (twenty-four) leg portions 110*d*. All configurations except for the number of leg portions 110*d* are the same as those of the bearing housing 100.

Referring to FIGS. 9 to 11, in the bearing housing 100 according to an embodiment of the disclosure, it is appropriate that the number of leg portions 110 is 12 (twelve). In response to the number of the leg portions 110 being greater than 12 (twelve), the axial stiffness and injection property are increased, but the space utilization is reduced than the increase of the axial stiffness and injection property. In response to the number of the leg portions 110 being less than 12 (twelve), the space utilization is increased, but the axial stiffness and injection property are reduced than the increase of the space utilization. Therefore, it is appropriate that the bearing housing 100 includes 12 (twelve) leg portions 110.

Figure 12:
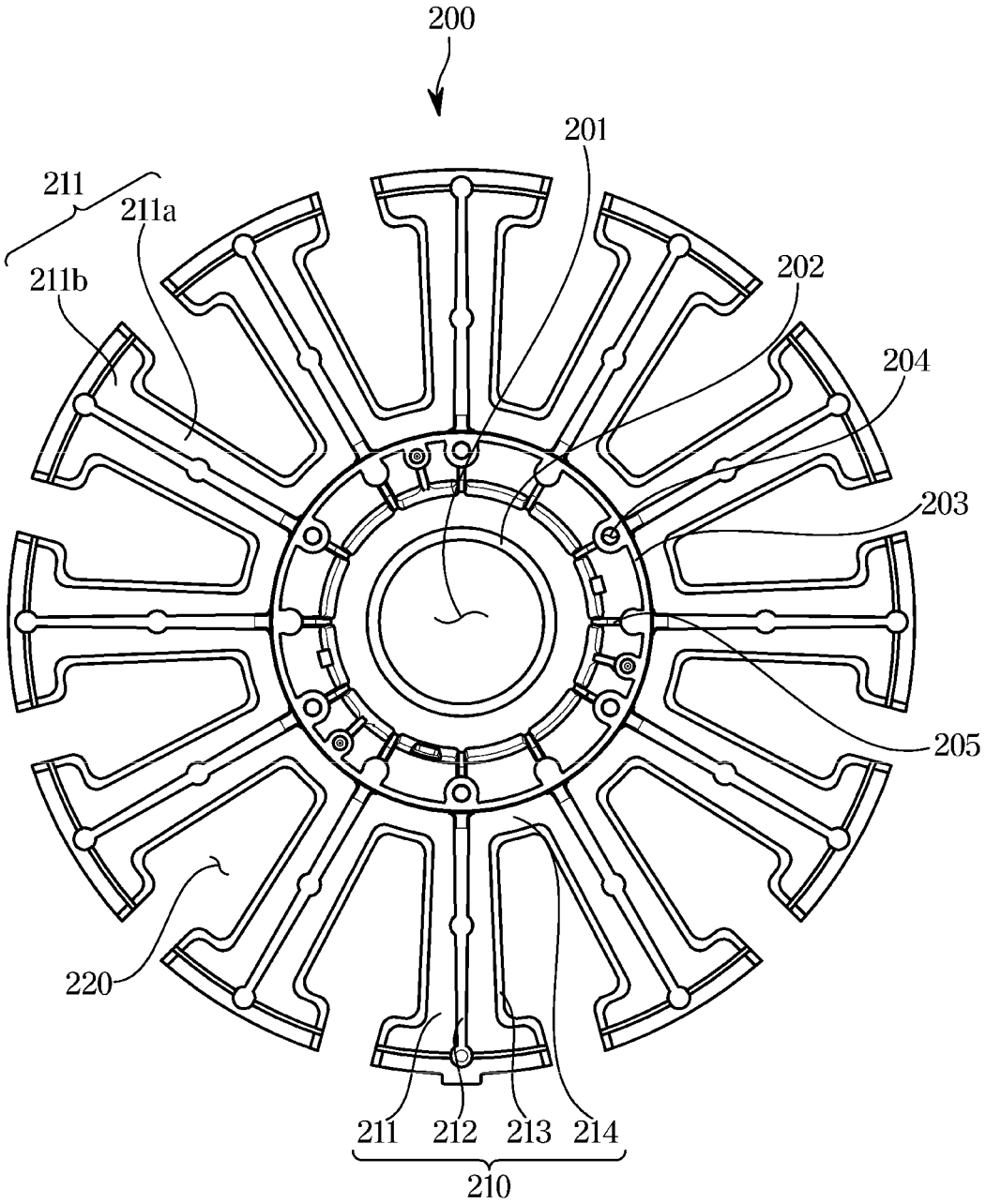
FIG. 12 is a view illustrating a bearing housing separated from a washing machine according to another embodiment of the disclosure.

FIG. 12 is a view illustrating a bearing housing separated from a washing machine according to another embodiment of the disclosure.

Hereinafter a structure of a bearing housing 200 according to another embodiment of the disclosure will be described with reference to FIG. 12.

Referring to FIG. 12, the bearing housing 200 according to another embodiment of the disclosure may include a shaft hole 201, a shaft support portion 202, a stator coupling portion 203, a fastening portion 204, and a reinforcing rib 205. The shaft hole 201, the shaft support portion 202, the stator coupling portion 203, the fastening portion 204 and the reinforcing rib 205 include the structure the same as the shaft hole 101, the shaft support portion 102, the stator coupling portion 103, the fastening part 104 and the shaft reinforcing rib 105.

The bearing housing 200 may include a leg portion 210.

The leg portion 210 may include a leg plate 211, a central rib 212, an outer rib 213, and a connection portion 214. In addition, the leg portion 210 may include a separation space 220.

According to another embodiment of the disclosure, the leg plate 211 may include a first plate portion 211*a* and a second plate portion 211*b*. The first plate portion 211*a* may have a constant width. A width of the second plate portion 211*b* may be greater than that of the first plate portion 211*a*. The second plate portion 211*b* may be provided at the other end of the leg plate 211.

Figure 13:
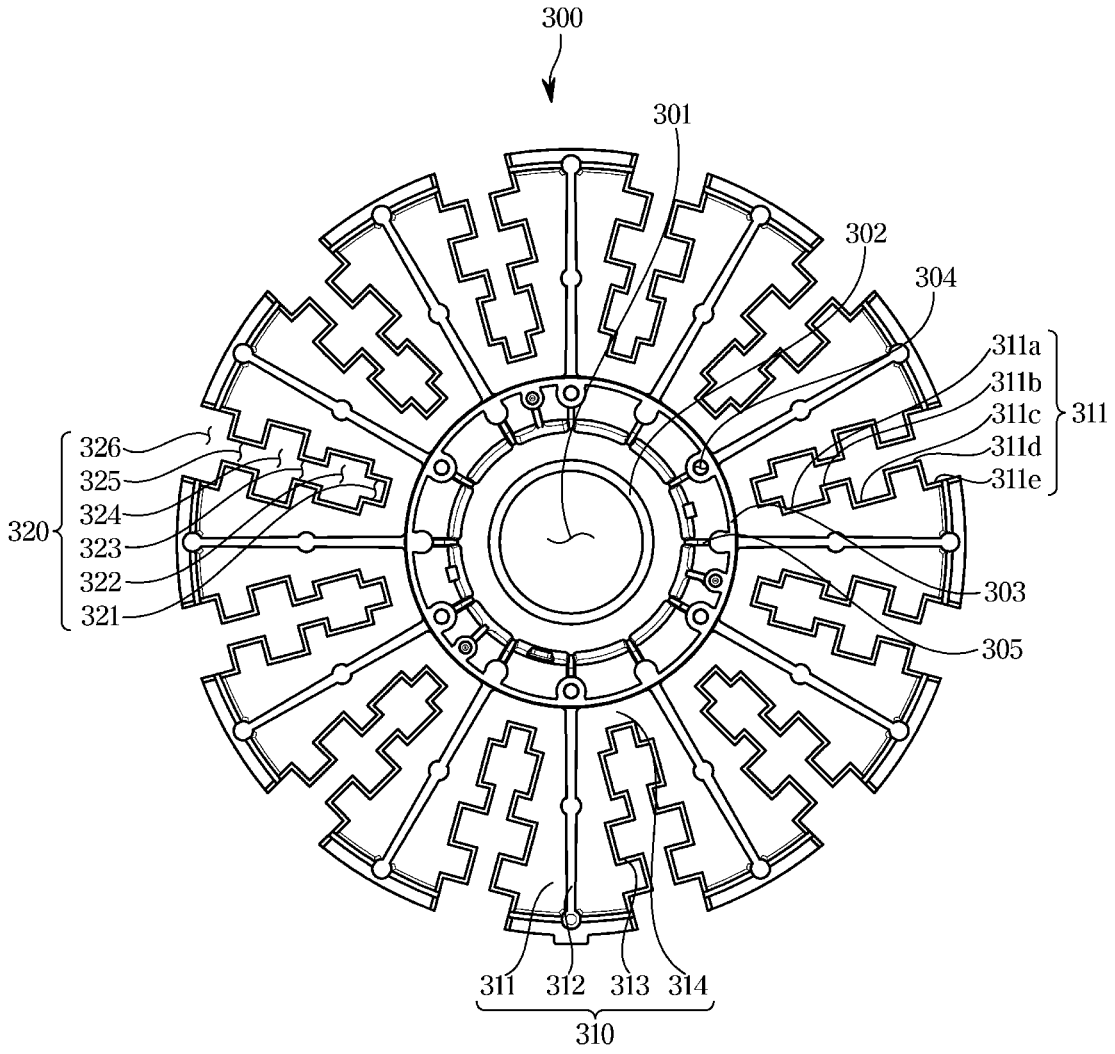
FIG. 13 is a view illustrating a bearing housing separated from a washing machine according to still another embodiment of the disclosure.

FIG. 13 is a view illustrating a bearing housing separated from a washing machine according to still another embodiment of the disclosure.

Referring to FIG. 13, a bearing housing 300 according to still another embodiment of the disclosure may include a shaft hole 301, a shaft support portion 302, a stator coupling portion 303, a fastening portion 304, and a reinforcing rib 305. The shaft hole 301, the shaft support portion 302, the stator coupling portion 303, the fastening portion 304 and the reinforcing rib 305 include the structure the same as the shaft hole 101, the shaft support portion 102, the stator coupling portion 103, the fastening part 104 and the shaft reinforcing rib 105.

The bearing housing 300 may include a leg portion 310.

The leg portion 310 may include a leg plate 311, a central rib 312, an outer rib 313, and a connection portion 314. In addition, the leg portion 310 may include a separation space 320.

According to still another embodiment of the disclosure, the leg plate 311 may include a first groove 311*a*, a first protrusion 311*b*, a second groove 311*c*, a second protrusion 311*d* and a third groove 311*e* which are sequentially arranged in a direction, in which the leg plate 311 extends, from the connection portion 314.

The first groove 311*a* may be formed by recessing one side of the leg plate 311 toward the central rib 312. The first groove 311*a* may be provided as a substantially rectangular groove. The first groove 311*a* may be provided on opposite sides of the leg plate 311.

Like the first groove 311*a*, the second groove 311*c* may be formed by recessing one side of the leg plate 311 toward the central rib 312 and provided as a substantially rectangular groove. A recess depth of the second groove 311*c* may be greater than a recess depth of the first groove 311*a*. The second groove 311*c* may be provided on opposite sides of the leg plate 311.

The first protrusion 311*b* may be provided between the first groove 311*a* and the second groove 311*c*. The first protrusion 311*b* may be provided in a shape protruding outward from one side of the leg plate 311, and provided as a substantially rectangular groove. The first protrusion 311*b* may be provided on opposite sides of the leg plate 311.

The second protrusion 311*d* may be provided at the other end of the second groove 311*c*. The first protrusion 311*b* may be provided at one end of the second groove 311*c*, and the second protrusion 311*d* may be provided at the other end of the second groove 311*c*. The second protrusion 311*d* may be provided on opposite sides of the leg plate 311.

The third groove 311*e* may be provided at the other end of the leg plate 311. The third groove 311*e* may be provided at one end of the second protrusion 311*d*. According to an embodiment of the disclosure, a recess depth of the third groove 311*e* and a recess depth of the second groove 311*c* may be the same. The third groove 311*e* may be provided on opposite sides of the leg plate 311.

Due to the above-described structure, the separation space 320 may include first to sixth separation spaces 321, 322, 323, 324, 325, and 326.

The separation space 320 may include a first separation space 321, a second separation space 322, a third separation space 323, a fourth separation space 324, a fifth separation space 325 and a sixth separation space 326 which are sequentially arranged from the stator coupling portion 303 to the outside.

A width of the first separation space 321, a width of the third separation space 323, and a width of the fifth separation space 325 may be the same. Further, a width of the fourth separation space 324 and a width of the sixth separation space 326 may be the same. A width of the second separation space 322 may be greater than the width of the first separation space 321, and less than the width of the third separation space 323.

In other words, the separation space 320 may include first separation spaces 321, 323, and 325 having a first width, a second separation space 322 having a second width different from the first width, and third separation spaces 324 and 326 each having a third width different from the first width and the second width.

Figure 14:
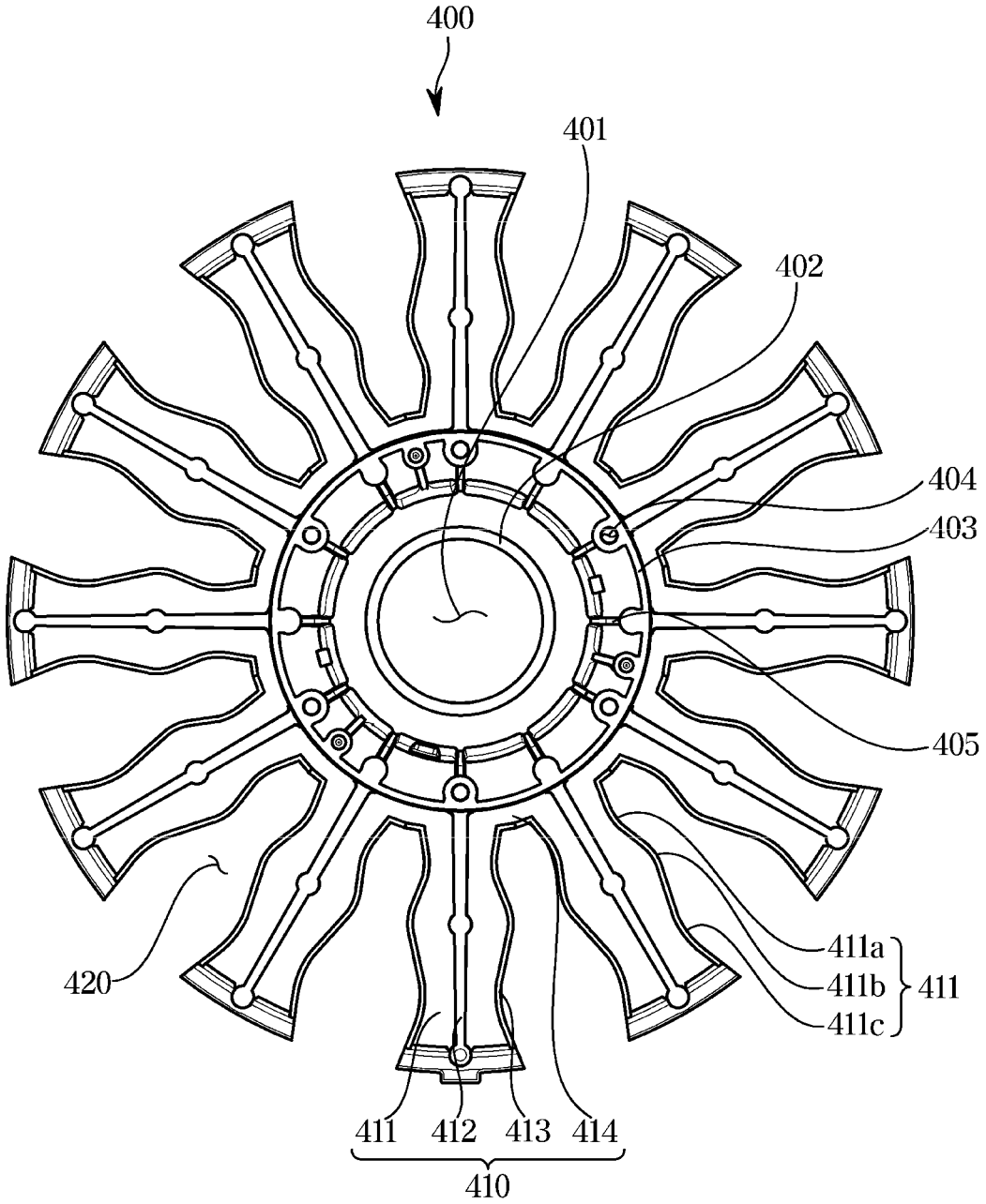
FIG. 14 is a view illustrating a bearing housing separated from a washing machine according to still another embodiment of the disclosure.

FIG. 14 is a view illustrating a bearing housing separated from a washing machine according to still another embodiment of the disclosure.

Referring to FIG. 14, a bearing housing 400 according to still another embodiment of the disclosure may include a shaft hole 401, a shaft support portion 402, a stator coupling portion 403, a fastening portion 404, and a reinforcing rib 405. The shaft hole 401, the shaft support portion 402, the stator coupling portion 403, the fastening portion 404 and the reinforcing rib 405 include the structure the same as the shaft hole 101, the shaft support portion 102, the stator coupling portion 103, the fastening part 104 and the shaft reinforcing rib 105.

The bearing housing 400 may include a leg portion 410.

The leg portion 410 may include a leg plate 411, a central rib 412, an outer rib 413, and a connection portion 414. In addition, the leg portion 410 may include a separation space 420.

The leg plate 411 may include a first concave portion 411*a*, a first convex portion 411*b*, and a second concave portion 411*c*.

The first concave portion 411*a*, the first convex portion 411*b*, and the second concave portion 411*c* may be sequentially arranged from the connection portion 414 toward the other end of the leg plate 411. In addition, the first concave portion 411*a*, the first convex portion 411*b*, and the second concave portion 411*c* may be provided on opposite side surfaces of the connection plate 411. The first concave portion 411*a*, the first convex portion 411*b*, and the second concave portion 411*c* may be continuously arranged. Accordingly, the opposite sides of the leg plate 411 may be provided in a substantially wave shape.

As is apparent from the above description, it is possible to provide a washing machine including a tub including an axial stiffness increased by improving a structure of a bearing housing.

Further, it is possible to provide a washing machine including improved space utilization at a center of a rear surface of a tub by improving a structure of a bearing housing.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:
a tub;
a drum rotatably installable inside the tub; and
a bearing housing to rotatably support a shaft configured to drive the drum while the drum is installed in the tub, the bearing housing being insertable into the tub, the bearing housing comprising:
a stator coupling portion to which a stator of a drive motor configured to rotate the shaft is coupled, and
a plurality of leg portions spaced apart from each other along a circumferential direction of the stator coupling portion, wherein each of the plurality of leg portions comprises:
a leg plate having a first end connected to the stator coupling portion and a second end formed to extend along a radial direction of the stator coupling portion from the first end;
a connection portion formed to extend from an outer circumferential surface of the stator coupling portion along the radial direction of the stator coupling portion and connect adjacent first ends of adjacent leg portions, among the plurality of leg portions, to each other, the connection portion connects the first ends of the adjacent leg portions with a separation space between adjacent second ends of the adjacent leg portions along a circumferential direction of the stator coupling portion; and
an outer rib spaced apart from the stator coupling portion along the circumferential direction of the stator coupling portion, the outer rib being formed to protrude from the leg plate along an edge of the leg plate and formed to protrude from an edge of the connection portion.

2. The washing machine of claim 1, wherein
the plurality of leg portions further comprises a central rib along a center of a respective leg plate of the plurality of leg portions, and
the central rib is formed to extend from the stator coupling portion to a portion adjacent to the second end.

3. The washing machine of claim 2, wherein
the outer rib and the central rib are respectively formed to protrude from the leg plate in an axial direction of the shaft.

4. The washing machine of claim 3, wherein
a length of the central rib along the axial direction of the shaft is greater than a length of the outer rib along the axial direction of the shaft.

5. The washing machine of claim 3, wherein
the central rib comprises:
a first column formed to extend in the axial direction of the shaft to reinforce a strength of the central rib and provided at one end of the central rib; and
a second column provided between the one end of the central rib and another end of the central rib.

6. The washing machine of claim 5, wherein
the central rib further comprises:
a first reinforcing rib provided on opposite sides of the first column; and
a second reinforcing rib positioned between the first column and the second column and provided on opposite sides of the central rib.

7. The washing machine of claim 6, wherein
a number of the plurality of leg portions is 12.

8. The washing machine of claim 3, wherein
a length of the outer rib along the axial direction of the shaft is 20 mm.

9. The washing machine of claim 1, wherein
the connection portion is formed to extend radially outward of the stator coupling portion from a side surface of the stator coupling portion.

10. The washing machine of claim 9, wherein
a length of the leg plate formed to extend from the first end to the second end is l, and a length of the connection portion formed to extend radially outward of the stator coupling portion from the stator coupling portion is t,
where $t/l=1/5$.

11. The washing machine of claim 1, wherein
the leg plate is provided to have a width that is reduced as a distance of the leg plate from the stator coupling portion increases.

12. The washing machine of claim 1, wherein the first end of the leg plate has a constant width, and the second end of the leg plate has a width smaller than the constant width.

13. The washing machine of claim 1, wherein
at respective portions, the separation space has a first width, a second width different from the first width, and a third width different from the first width and the second width.

14. The washing machine of claim 1, wherein the plurality of leg plates comprises at least one concave portion and at least one convex portion, which are provided on opposite sides of the plurality of leg portions between the first ends of the adjacent leg portions to the second ends of the adjacent leg portions among the plurality of leg portions.

* * * * *